US005397165A

United States Patent [19]

Grin et al.

[11] Patent Number: 5,397,165

[45] Date of Patent: Mar. 14, 1995

[54] SYNCHRONOUS MOVEMENT ADJUSTABLE SEAT SUPPORT

[75] Inventors: Itzhak Grin, Evtah, Israel; Markus Schmidt, Betzdorf, Germany

[73] Assignee: Paltechnica Nitzanim, Evtah, Israel

[21] Appl. No.: 82,466

[22] Filed: Jun. 28, 1993

[30] Foreign Application Priority Data

Oct. 20, 1992 [IL] Israel ..... 103477

[51] Int. Cl.[6] ..... A47C 1/032

[52] U.S. Cl. ..... 297/301; 297/304; 297/322

[58] Field of Search ..... 297/301, 322, 320, 304, 297/313, 306, 328

[56] References Cited

U.S. PATENT DOCUMENTS

| | | | |
|---|---|---|---|
| 2,859,799 | 11/1958 | Moore | 297/301 |
| 4,062,587 | 12/1977 | Wolters . | |
| 4,198,094 | 4/1980 | Bjerknes . | |
| 4,438,978 | 3/1984 | Arild . | |
| 4,502,729 | 3/1985 | Locher | 297/301 |
| 4,537,445 | 8/1985 | Neuhoff | 297/322 X |
| 4,636,004 | 1/1987 | Neumuller . | |
| 4,668,012 | 5/1987 | Locher | 297/301 X |
| 5,071,189 | 12/1991 | Kratz | 297/320 X |
| 5,308,144 | 5/1994 | Korn | 297/301 |

FOREIGN PATENT DOCUMENTS

| | | | |
|---|---|---|---|
| 8100040 | 1/1981 | European Pat. Off. . | |
| 250995 | 1/1988 | European Pat. Off. | 297/301 |

*Primary Examiner*—Peter R. Brown

*Attorney, Agent, or Firm*—Natter & Natter

[57] ABSTRACT

A seat support includes a base having a socket for receiving the end of a vertical support post. The base is not tiltable relative to the support post and extends toward the forward edge of a seat. A rearwardly downwardly inclined transverse crank slot is formed in the base adjacent the forward end of the base. Adjacent the post socket, the base includes a transverse slider pivot axis with an upwardly, rearwardly extending crank being connected to the base at the pivot axis. The crank includes a transverse pivot axis and a seat back support is fixed to the crank. Interconnecting the transverse slot of the base and the pivot axis of the crank is a slider. The slider is mounted to the underside of the seat and is pinned through the slot at its forward end. The rear end of the slider is connected to the slider pivot axis of the crank. When the seat is tilted rearwardly, the crank rotates rearwardly about the crank pivot axis and the angle of the. slider, hence the angle of the seat, inclines rearwardly. With the forward end of the slider connected to the slot, the forward end of the slider translates downwardly and rearwardly to compensate for increased elevation at the forward edge of the seat.

20 Claims, 6 Drawing Sheets

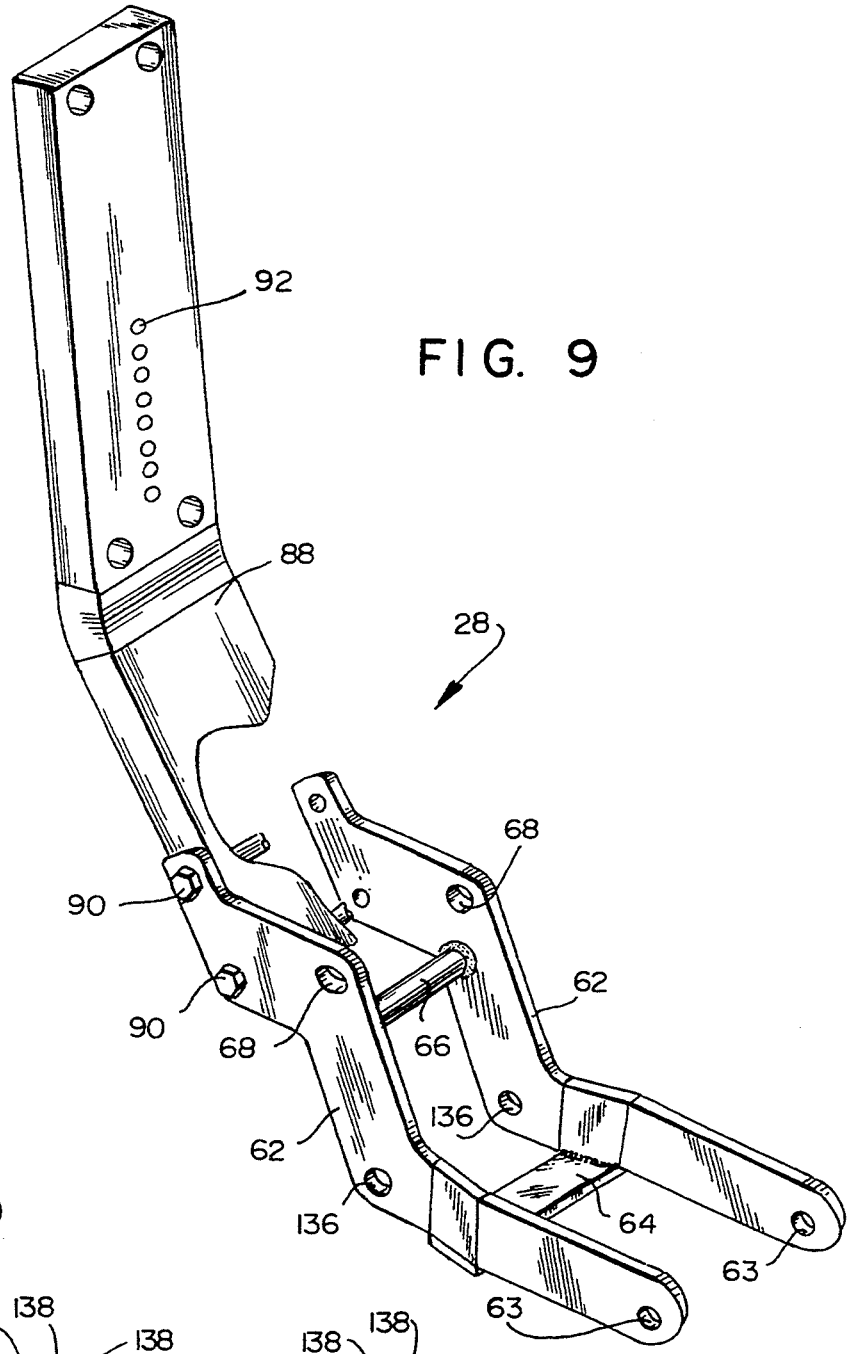
FIG. 9
FIG. 10
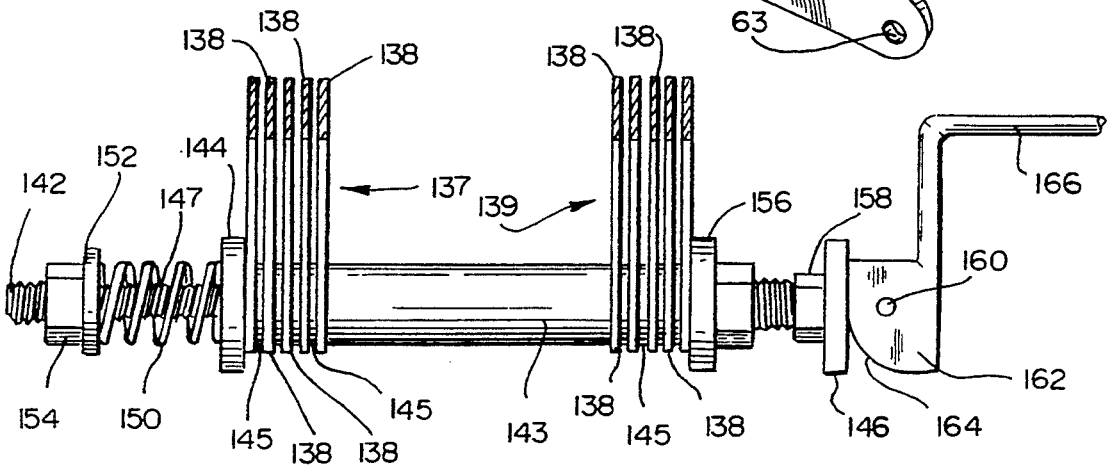

SYNCHRONOUS MOVEMENT ADJUSTABLE SEAT SUPPORT

BACKGROUND OF THE INVENTION

1. Field of the Invention

This invention relates generally to seating and more particularly to office type swivel chairs capable of adjustment of the seat tilt or inclination angle and the seat back angle.

2. Related History

Various desk or work station chairs having a seat, a seat back and possibly arm rests together with a support mechanism which interconnected at least the chair seat to a vertical post have been generally characterized as "office" chairs. The post usually included, at its base, a spider having radially projecting horizontal legs with depending casters for rolling contact with a floor support surface. Adjustment of the seat elevation was achieved through adjustment of the post height or the position of the seat support mechanism relative to the post. The seat support mechanisms often included a fixed pivot for adjustably varying the angle of the seat back relative to the seat.

Numerous seat support mechanisms which interconnected the seat with the support post and provided for adjustment of the horizontal inclination or tilt, of the seat have been suggested. Examples of some of these mechanisms are illustrated in U.S. Pat. No. 4,438,978, issued Mar. 27, 1984, U.S. Pat. No. 4,198,094, issued Apr. 15, 1980, U.S. Pat. No. 4,636,004, issued Jan. 13, 1987 and European Patent WO 81/00044, issued Jan. 22, 1981.

Unfortunately, a majority of the prior seat support mechanisms were designed without due consideration of the human anatomy. A principal drawback with respect to prior seat support mechanisms was that because the seat tilt axis was located rearwardly of the front edge of the seat, as the seat was tilted rearwardly, the front edge of the seat elevated, resulting in increased popliteal pressure in the areas of the peroneal and sciatic nerves. Such pressure generated a sensation of discomfort and strain rather than relaxation when the seat occupant tilted the seat back to obtain what would otherwise have been a more comfortable Seating position relative to the user's desk, workbench, terminal or other work station.

A further problem encountered with respect to prior seat and seat back support mechanisms, such as that illustrated in U.S. Pat. No. 4,062,587, was that the pivot point for seat back movement relative to the seat was often improperly selected and when a user adjusted the seat angle or tilted the seat rearwardly in synchronous movement seat support mechanisms which automatically adjusted the seat back angle when the seat was tilted, a noticeable change of the point of engagement between the seat back and the user's back resulted. Such dimensional change generated an undesirable translatory pressure along the user's spinal column.

SUMMARY OF THE INVENTION

The invention comprises a seat support mechanism premised upon a geometric slider crank linkage which assures that the forward edge of the seat declines in elevation as a function of increasing the backward tilt angle of the seat. As such, the mechanism compensates for the increase in the elevation of the front edge of the seat when the seat is tilted rearwardly.

The seat support mechanism includes a horizontally fixed, i.e. nontiltable, base frame which is secured to an end of an upright support post. The base frame extends upwardly toward the front edge of the seat and includes, adjacent its forward end, a transverse slot which is inclined rearwardly and downwardly from the forward end.

A transverse crank pivot axis extends through the base frame adjacent its opposite end, i.e. adjacent the support post. One end of a crank is connected to the base frame at the crank pivot axis with the crank extending upwardly and rearwardly towards the rear edge of the seat. Adjacent the rear end of the crank, a transverse slider pivot axis is provided.

One end of a slider is pivotally connected to the slider pivot axis and the opposite end of the slider is connected to a pin which is received within the slot formed adjacent the forward end of the base frame. The slider carries the chair seat.

When the seat is tilted rearwardly, the crank rotates rearwardly about the crank axis to lower the elevation of the slider pivot axis, hence lower the elevation of the rear edge of the seat. Simultaneously, the forward end of the slider translates rearwardly and downwardly, guided by the engagement of the pin in the slot to effectively lower the elevation of the front edge of the seat. Such lowering compensates for the increase in seat front edge elevation caused by the rearward pivoting of the seat.

A further feature of the seat support mechanism resides in the employment of a helical coil spring which is carried within the base frame coaxial with the longitudinal frame axis. The coil spring counterbalances the weight of a user when adjusting the seat tilt angle. One end of the spring is biased against the pin which is engaged in the slot to urge the slider, hence the front end of the seat, forwardly to a generally horizontal position. The opposite end of the spring is seated in a retainer which is carried on a threaded shaft for force adjustment. A plastic wormwheel is molded to the threaded shaft and is engaged to rotate the shaft to adjust the position of the retainer. The thrust load of the spring is absorbed by a transverse bearing wall of the base frame.

A further aspect of the invention resides in the employment of a seat back tilt axis relative to the seat in alignment with the rotation point of the user's hip joint.

To lock the seat support mechanism at a selected tilt position, a plurality of friction lamination plates extend between the crank arm and a transverse shaft carried by the slider. The slider shaft extends through a slot formed in the lamination plates while the opposite end of each lamination plate rotates about a transverse pin secured in the crank. A compression abutment is fixed to the slider shaft and the shaft is axially loaded by a compression spring to force the abutment against the friction lamination plates and thereby prevent movement of the slider relative to the crank arm. To release the abutment plates and permit free movement of the slider crank linkage, a release lever is actuated.

The seat support mechanism also includes an auxiliary leaf spring assembly which projects rearwardly from the base frame and which engages a transverse bar in the crank as the seat approaches its most rearwardly tilted position. The leaf spring assembly augments the counterbalance spring force provided by the helical coil spring.

From the foregoing compendium, it will be appreciated that it is an aspect of the present invention to provide a seat support mechanism of the general character described which is not subject to the disadvantages of the background art aforementioned.

It is a consideration of the present invention to provide a seat support mechanism of the general character described wherein the seat does not tilt about a fixed axis.

To provide a synchronous seat support mechanism of the general character described which employs a geometric slider crank linkage is a feature of the present invention.

Another aspect of the present invention is to provide a seat support mechanism of the general character described which is suitable for economical mass production fabrication.

To provide a seat support mechanism of the general character described wherein the elevation of the seat support mechanism adjacent the forward edge of a seat is reduced while the seat is being titled backward is yet a further consideration of the present invention.

Another consideration of the present invention is to provide a seat support mechanism of the general character described which reduces worker fatigue.

An additional feature of the present invention is to provide a synchronous seat support mechanism of the general character described which is premised upon a slider crank linkage wherein a seat is fixed relative to a slider and a seat back support is fixed relative to a crank with the crank and slider being pivotally interconnected for movement relative to one another in an area beneath the rotation center of the user's hip joint.

A still further aspect of the present invention is to provide a seat support mechanism of the general character described wherein a helical counterbalance spring is augmented by an auxiliary leaf spring.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations are attained, all with reference to the accompanying drawings and the scope of which will be more particularly pointed out indicated in the appended claims.

BRIEF DESCRIPTION OF THE DRAWINGS

In the accompanying drawings in which are shown some of the various possible exemplary embodiments of the invention.

FIG. 9 is a fragmentary perspective illustration of a crank of the slider crank linkage with portions broken away, and illustrating an upwardly projecting seat back support fixed to an end of the crank; and FIG. 10 is an auxiliary fragmentary view of a friction lamination plate assembly for fixing the seat support mechanism at an adjusted seat tilt angle, the same being taken substantially along the plane 10—10 of FIG. 5.

DESCRIPTION OF THE PREFERRED EMBODIMENT

Figure 1:
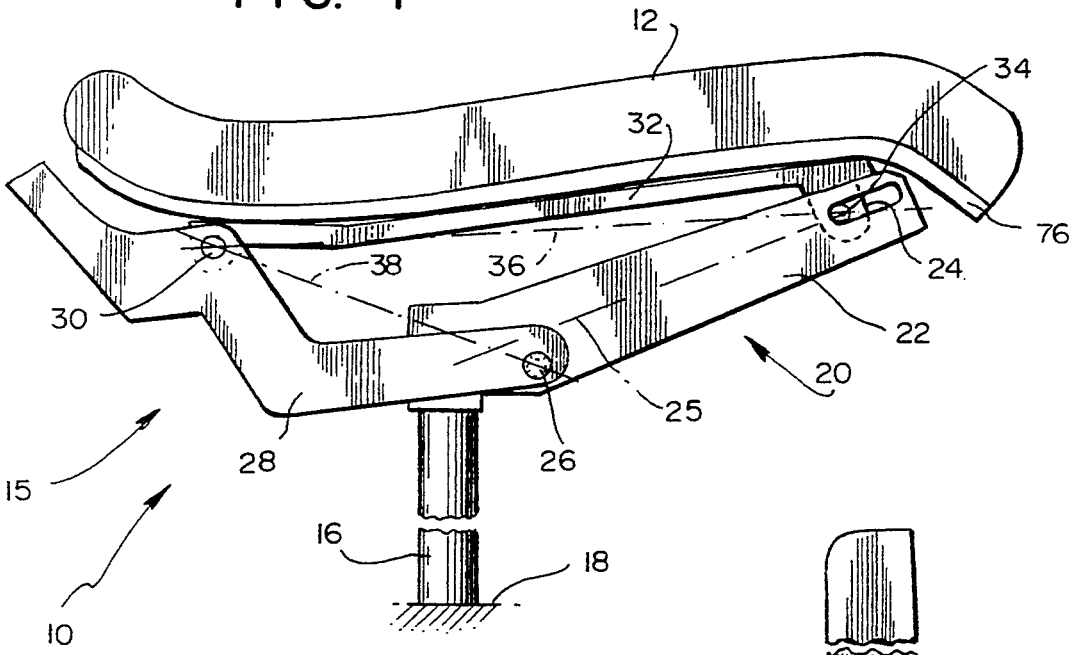
FIG. 1 is a right side elevational view of a seat of an office chair by a synchronous movement adjustable seat support constructed in accordance with and embodying the invention, the seat support interconnecting the seat and a support post and with portions deleted for clarity and showing a slider crank linkage in its most rearwardly tilted position.

Referring now in detail to the drawings, the reference numeral 10 denotes generally an office type chair. The chair 10 includes a seat 12 and a seat back 14 (illustrated in FIG. 4) interconnected to one another for simultaneous positional adjustment through a synchronous movement adjustable seat support 15 constructed in accordance with and embodying the present invention. The synchronous movement adjustable seat support 15 interconnects the seat 12 and the seat back 14 to a vertical support post 16 which extends upwardly from a horizontal support surface such as a floor 18. The post includes a base comprising a spider having radially projecting horizontal legs which terminate with depending casters for rolling contact with the floor 18. This conventional post base structure is not illustrated in the drawings which depict the post as being fixed to the floor 18 because the post 16 always remains perpendicular to the floor 18 and adjustment of seat tilt angle and seat back angle in accordance with the invention relate solely to a horizontal plane through or parallel to the floor 18.

In accordance with the present invention, the synchronous movement adjustable seat support 15 is structurally premised upon a geometric slider crank linkage 20, which provides compensation for the increase in elevation of the front edge of the seat 12 caused by rearward tilting of the seat.

Figure 5:
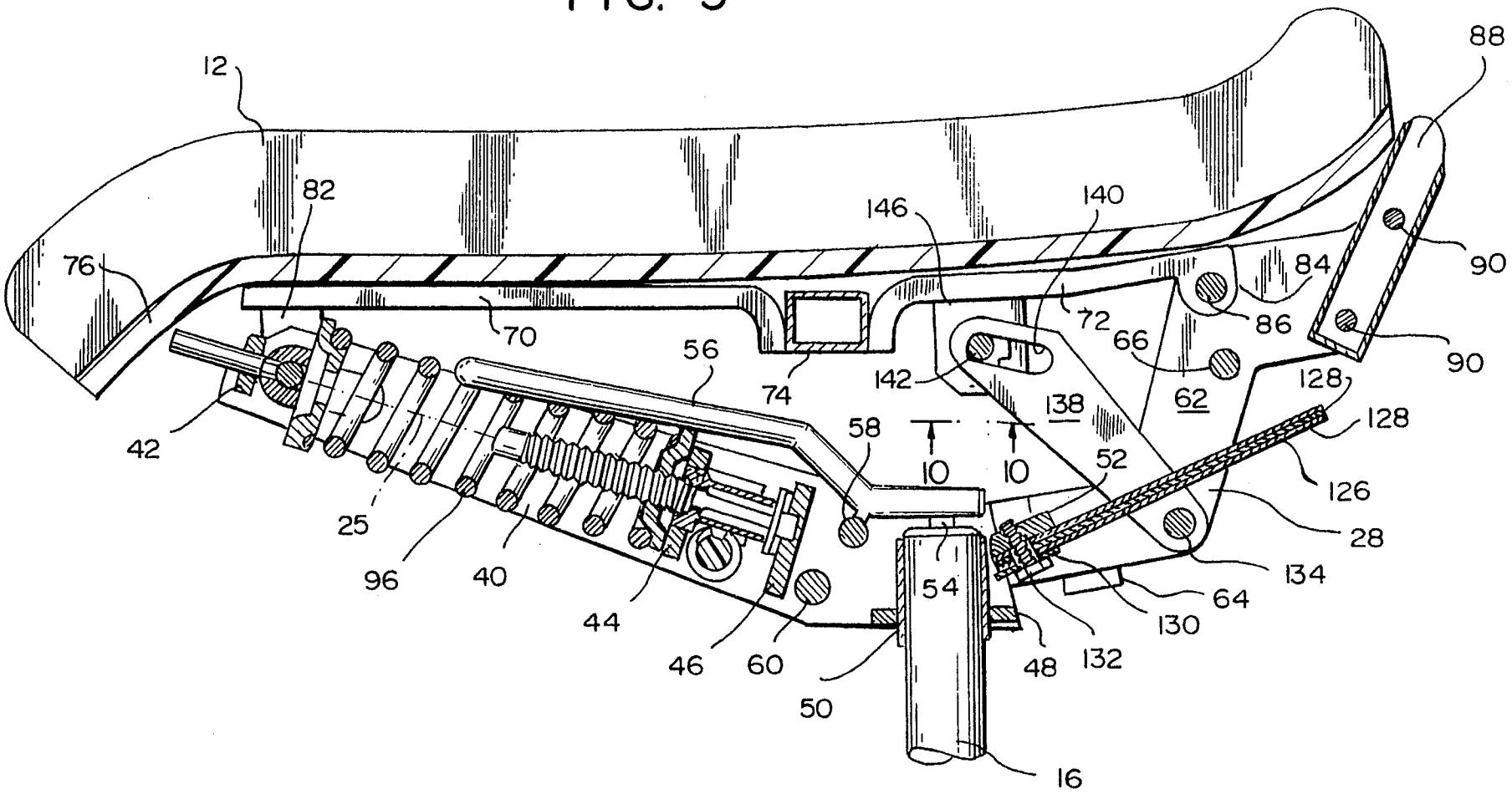
FIG. 5 is an enlarged scale longitudinal sectional view through the seat and the adjustable seat support and illustrating springs for counterbalancing the weight of an occupant when the tilt position of the seat is adjusted and one of a plurality friction lamination plates which lock the seat in its adjusted position.
Figure 6:
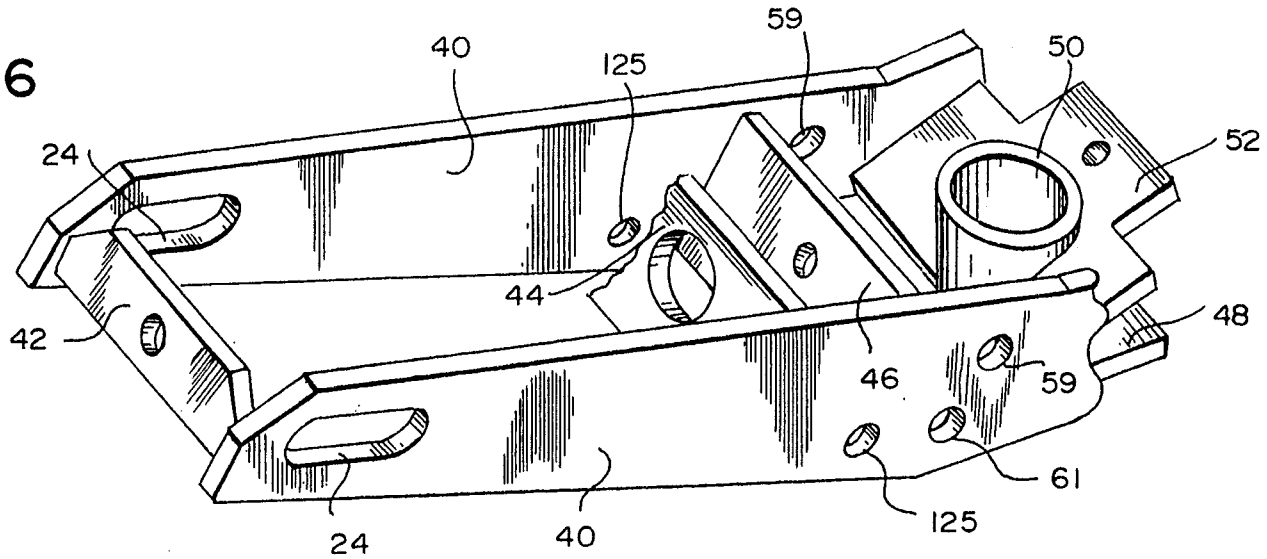
FIG. 6 is an enlarged scale fragmentary perspective bottom view of base frame of the seat support.
Figure 7:
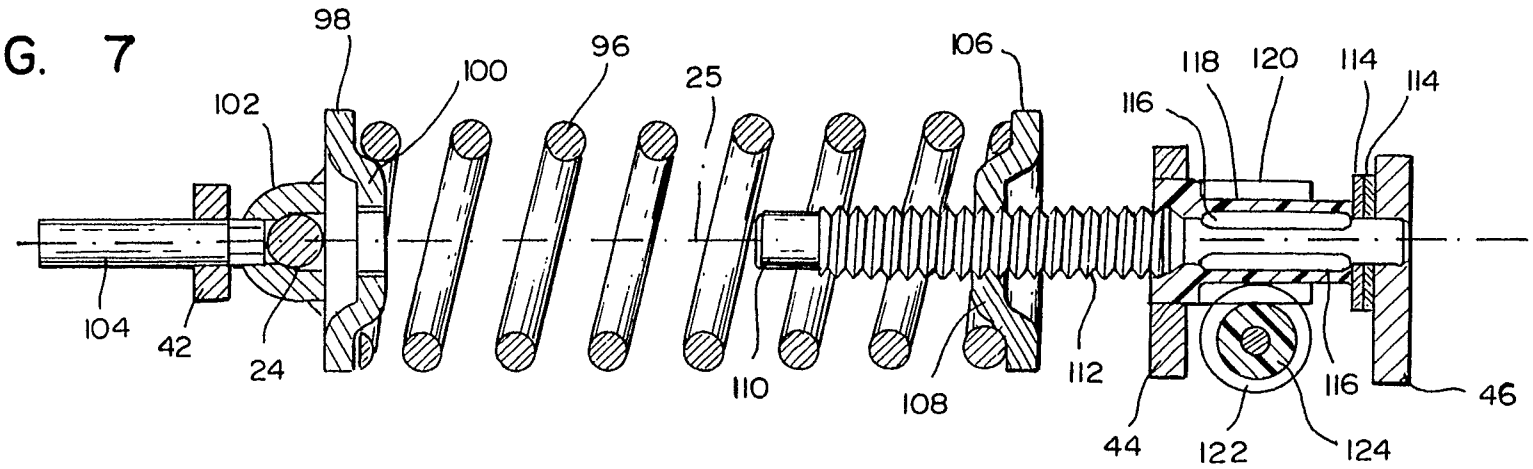
FIG. 7 is a greatly enlarged longitudinal fragmentary sectional view through the base frame, with portions deleted for clarity and showing a counterbalance helical coil spring together with a spring force adjustment mechanism.

The slider crank linkage 20 includes a base frame 22, the structural components of which are illustrated in FIG. 6. The base frame 22 is nontiltably connected, in a manner to be subsequently described, to the support post 16 adjacent the rear end of the base frame 22. As illustrated in FIGS. 1 and 5, the base frame 22 extends from the support post 16, upwardly toward the front edge of the seat 12. Adjacent the forward end of the base frame, a transverse slot 24 is provided. The slot 24 is inclined downwardly and rearwardly toward the rear end of the base frame along an axial plane denoted generally by the numeral 25 in FIG. 1.

Adjacent the rear end of the base frame 22, a transverse crank pivot axis 26 is provided. Pivotally connected to the base frame at the crank pivot axis 26 is a crank, 28, the structural details of which are illustrated in FIG. 9. The crank 28 extends from the crank pivot axis 26 upwardly toward the rear edge of the seat 12 and includes a transverse slider pivot axis 30 at an elevation from the support floor 18 which is higher than the elevation of the crank pivot axis.

An elongate slider 32 is pivotally connected at one of its ends to the crank 28 at the slider pivot axis 30. Adjacent its opposite end, the slider 32 is connected to a pin 34 which is seated in the transverse slot 24 of the base frame 22.

With reference to the components of the slider crank linkage 20 as depicted in FIG. 1, it should be noted that the reference numeral 36 denotes a plane common to the centers of the slider pivot axis 30 and the transverse pin 34. Similarly, the reference numeral 38 denotes a plane common to the crank pivot axis 26 and the slider pivot axis 30.

From an examination of FIG. 1, wherein the slider 32, hence the seat 12 is depicted in its maximum rearward tilt position, it should be appreciated that the transverse pin 34 serves to constrain counterclockwise (as viewed in FIG. 1) movement of the crank 28 by engagement against a lower end of the transverse slot 24 and clockwise movement by engagement against the upper end of the transverse slot 24.

Figure 3:
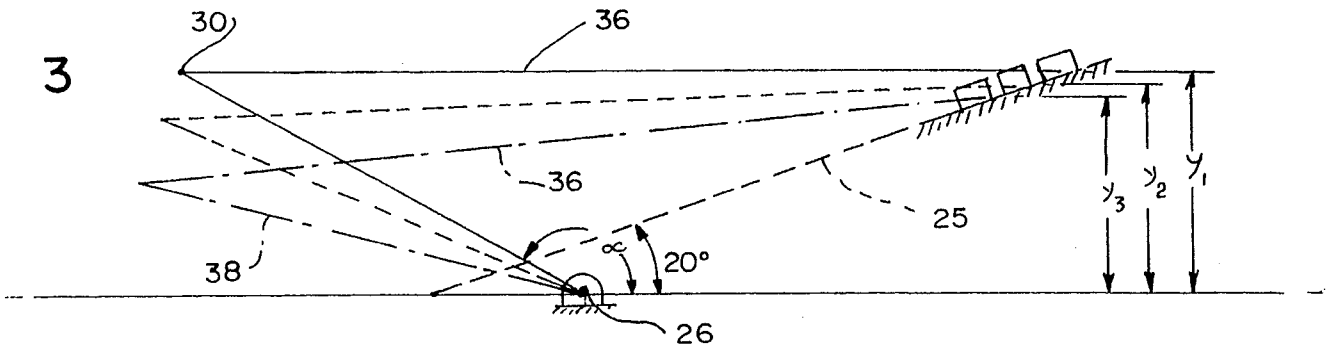
FIG. 3 is a motion diagram of the slider crank mechanism illustrating the elevation of the forward end of the slider at various positions throughout its range of permissible movement.

Movement of the seat 12 in accordance with the slider crank linkage 20 from a normal maximum forward tilt, more or less horizontal, position to the maximum rearward tilt position depicted in FIG. 1 is illustrated in the motion diagram of FIG. 3.

Such motion diagram is premised upon the following dimensional relationships of the slider crank linkage:

The angle of the axial plane 25 with respect to a horizontal plane 27 passing through one crank pivot axis 26=20°.

The distance "A" between the pivot axes 26, 30 along the plane 38=3.38 units.

The distance "B" between the axis 30 and the pin 34 on the plane 36=6.25 units.

The distance "D" along the horizontal plane 27 between the axis 26 and intersection of the plane 25 with the horizontal plane 27=1.13 units.

With the seat in the maximum forward tilt position, as depicted in the solid lines of FIG. 3, the elevation $y_1$ of the axis of the transverse pin 34, at the forward end of the slider, as measured from the horizontal plane 27 is 1.68 units. In the configuration so depicted, the angle $\alpha$ between the horizontal plane 27 and the plane 38 is 145°.

As the seat is titled rearwardly, the angle $\alpha$ increases to 155° at an intermediate position depicted in dashed lines in FIG. 3.

Due to the geometric relationship of the slider crank linkage 20, in such configuration, the elevation $y_2$ of the axis of the transverse pin 34 decreases to 1.58 units. Such decrease will at least partially compensate for the increase in elevation of the front edge of the seat which would have otherwise been encountered due to the increased rearward tilt of the seat.

In the final, maximum tilt position of the seat, depicted in the motion diagram of FIG. 3 in dot and dash lines, the elevation $y_3$ of the transverse pin 34, relative to the horizontal plane 27, has decreased to 1.49 units with the counterclockwise rotation of the crank resulting in an angle between the horizontal plane and the plane 38 of 165°.

The geometric relationship between the angle between the horizontal plane 27 and the crank plane 36 passing through the axes 30 and 34 and the elevation y of the slider pin axis can be generated as follows:

$$\sin(\epsilon+\beta)=\frac{\sin(\alpha-\epsilon)}{B}\cdot\left(A-\frac{D\sin}{\sin(\alpha-\epsilon)}\right) \tag{1}$$

$$\beta=\arcsin\frac{[A\sin(\alpha-\epsilon)-D\sin\epsilon]}{[B]}-\epsilon$$

where $\beta$ is the angle of inclination of the plane 36 from the horizontal.

$$E=\frac{B\sin(\alpha+\beta)}{\sin(\alpha-\epsilon)}+d \tag{2}$$

$$d=\frac{D\sin}{\sin(\alpha-\epsilon)}$$

where d is the distance along the axial plane 25 between the intersection of the plane 25 and a horizontal plane 27, the crank axis 26 and the intersection with the plane 38.

$$E=\frac{1}{\sin(\alpha-\epsilon)}\cdot[B\sin(\alpha+\beta)+D\sin\alpha]$$

where "E" is the distance along the axial plane 25 between the pin 34 and the intersection with the plane 35 and $$x=E\cos\epsilon-D$$

$$x=\frac{\cos\epsilon}{\sin(\alpha-\epsilon)}\cdot[B\sin(\alpha+\beta)+D\sin\alpha]-D$$

where "x" is the distance along the horizontal plane 27 between the axis 26 and the axis of the slider pin 34 and $$y=E\sin\epsilon$$

$$y=\frac{\sin\epsilon}{\sin(\alpha-\epsilon)}\cdot[B\sin(\alpha+\beta)+D\sin\alpha]$$

where "y" is the elevation of the slider pin from the horizontal plane 27.

Referring now to FIG. 6 wherein the base frame 22 is shown in an inverted position, it will be appreciated that the base frame 22 is formed of a pair of planar metal side panels 40 held in parallel spaced relation to one another by a plurality of cross members formed of metal plates of substantially the same thickness as the side panels and unitarily joined, at their ends, to the side panels as, for example, by welding. The cross members comprise a forward cross plate 42 adjacent the forward end of the base frame, an intermediate cross plate 44, and a rear retainer cross plate 46. The cross plates 42, 44, and 46 are substantially parallel to one another, as illustrated in FIG. 6.

Additionally, a generally horizontal cross plate 48 is provided. The horizontal cross plate 48 includes an enlarged central aperture through which is secured a vertical cone sleeve 50 which receives the upper end of the support post 16. Secured across the inner faces of the side panels 40 is a further, angular cross plate 52 which is also mounted to the cone sleeve 50 and to which an auxiliary leaf spring is mounted as will be explained hereinafter.

In FIG. 5, the adjustable seat support 15 is illustrated secured over the vertical support post 16 with the upper end of the post 16 being seated in the cone sleeve 50. In instances wherein the support post 16 is pneumatically adjustable and includes an upper actuation button 54 for height adjustment, the seat support 15 includes a height adjustment lever 56 which extends between the side panels 40 and which is joined, as by welding, to a rotatable pin 58 which extends through transverse holes 59 in the side panels 40. At the forward end of the lever 56, the lever is bent perpendicularly to extend over the right side panel 40. To depress the adjustment button 54 and change the elevation of the seat, the lever is grasped beneath the seat with the user's right hand and is pulled upwardly, pivoting about the pin 58.

As previously mentioned, the adjustable seat support 15 includes a crank 28 which is pivotally connected to the base frame 22 about a crank pivot axis 26. The crank pivot axis 26 carries a pin 60 which extends through transverse apertures 61 of the side panels 40.

With reference now to FIG. 9 wherein the crank 28 is illustrated in greater detail, it will be seen that the crank 28 includes a pair of substantially parallel crank arms 62 which are maintained in spaced parallel relationship by a lower plate 64 and a transverse rod 66. Adjacent the lower end of each crank arm 62, an aperture 63 is provided through which gudgeon portions of the pivot axis pin 60 extend.

The crank 26 extends rearwardly and upwardly toward the rear edge of the seat and includes, adjacent the rear portion of the seat in alignment with the approximate location of the rotation center of an occupant's hip joint, a transverse bore 68 extends through each of the crank arms. The transverse bores 68 are concentric with the slider pivot axis 30.

Figure 8:
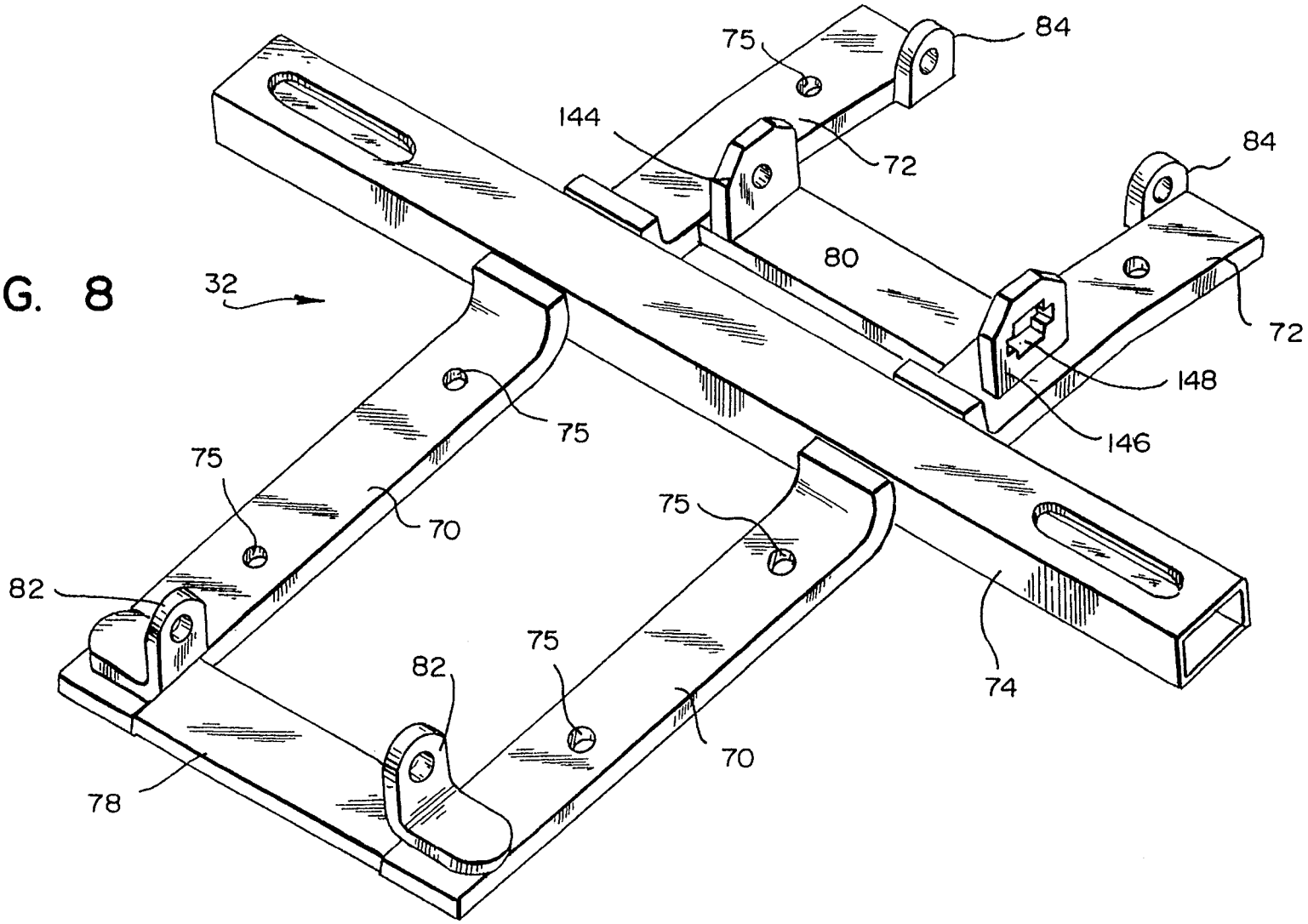
FIG. 8 is an enlarged scale inverted perspective illustration of a slider of the slider crank linkage.

With reference now to FIG. 8 wherein a detailed perspective bottom view of the slider is depicted, it should be noted that the slider is actually formed of a pair of substantially parallel front bars 70 and a pair of registered rear bars 72 joined together, at their intersection, by a hollow transverse channel 74. The front and rear bars 70, 72 include suitable apertures 75 for screws or other fasteners for mounting to a seat bottom 76.

A transverse plate 78 maintains the spaced relationship between the bars 70 at their forward ends and the bars 70 are joined to the transverse channel 74, as by welding, at their rear ends. Similarly, the rear bars 72 are joined to the transverse channel 74, as by welding, and a further transverse plate 80 extends across the rear bars 72.

Projecting downwardly adjacent the front end of each front bar 70 is an angle bracket 82. The brackets 82 include registered transverse bores which receive the pin 34, seated in the transverse slot 24. Similarly, a pair of brackets 84 project downwardly adjacent the distal end of each rear bar 72. The brackets 84 include registered transverse bores through which a pin 86 extends. The journal ends of the pin 86 extend through the transverse bores 68 of the crank arms 62.

It should be noted in passing that the transverse channel 74 of the slider may be utilized if desired, to adjustably mount brackets which carry arms for the chair. For this purpose, there is provided, adjacent each end of the transverse channel, a suitable slot with the seat arm brackets being received through the open ends of the channel and anchored in a desired position through a suitable fastener which engages its respective seat arm bracket through the slot.

Figure 2:
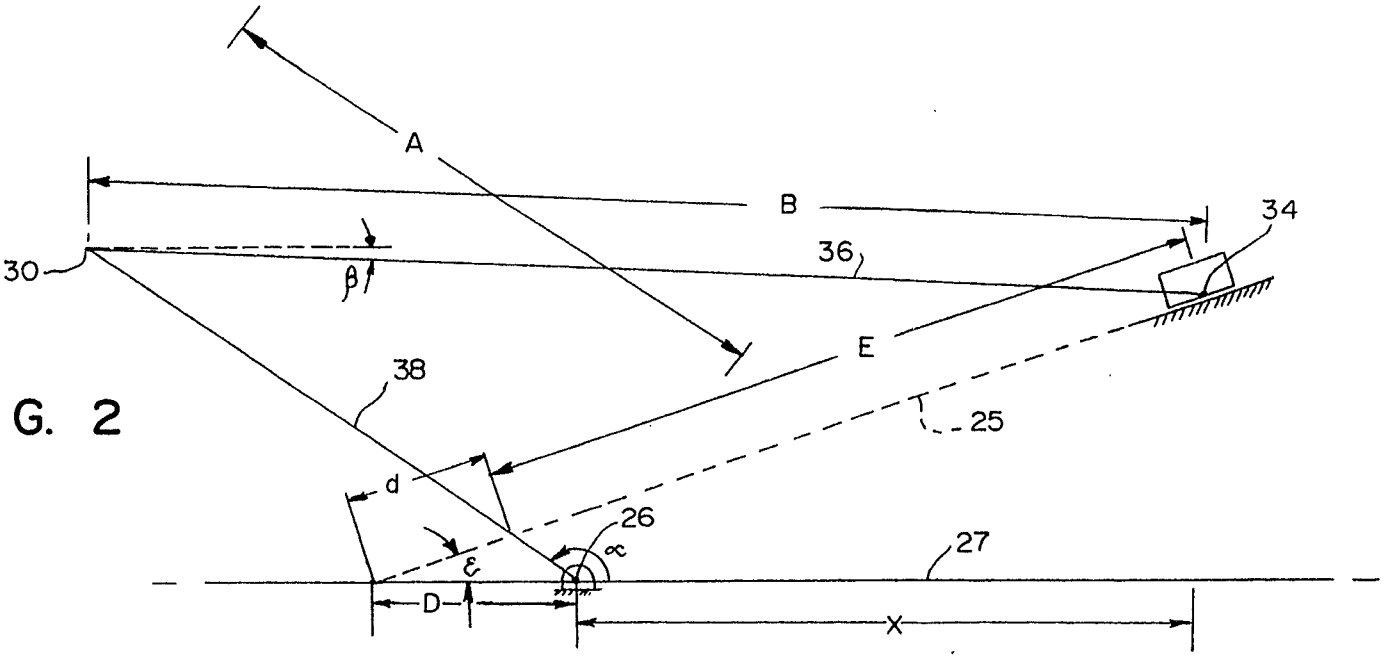
FIG. 2 is a schematic illustration of the slider crank linkage and depicting a crank pivotally secured to a fixed base and a slider pivotally secured, at one of its ends, to the crank and constrained to linear sliding movement at its opposite end.

From the foregoing, the interrelationship between the actual structural components and the components as depicted in the schematic and motion diagrams illustrated in FIGS. 1, 2 and 3, will be more readily appreciated.

Figure 4:
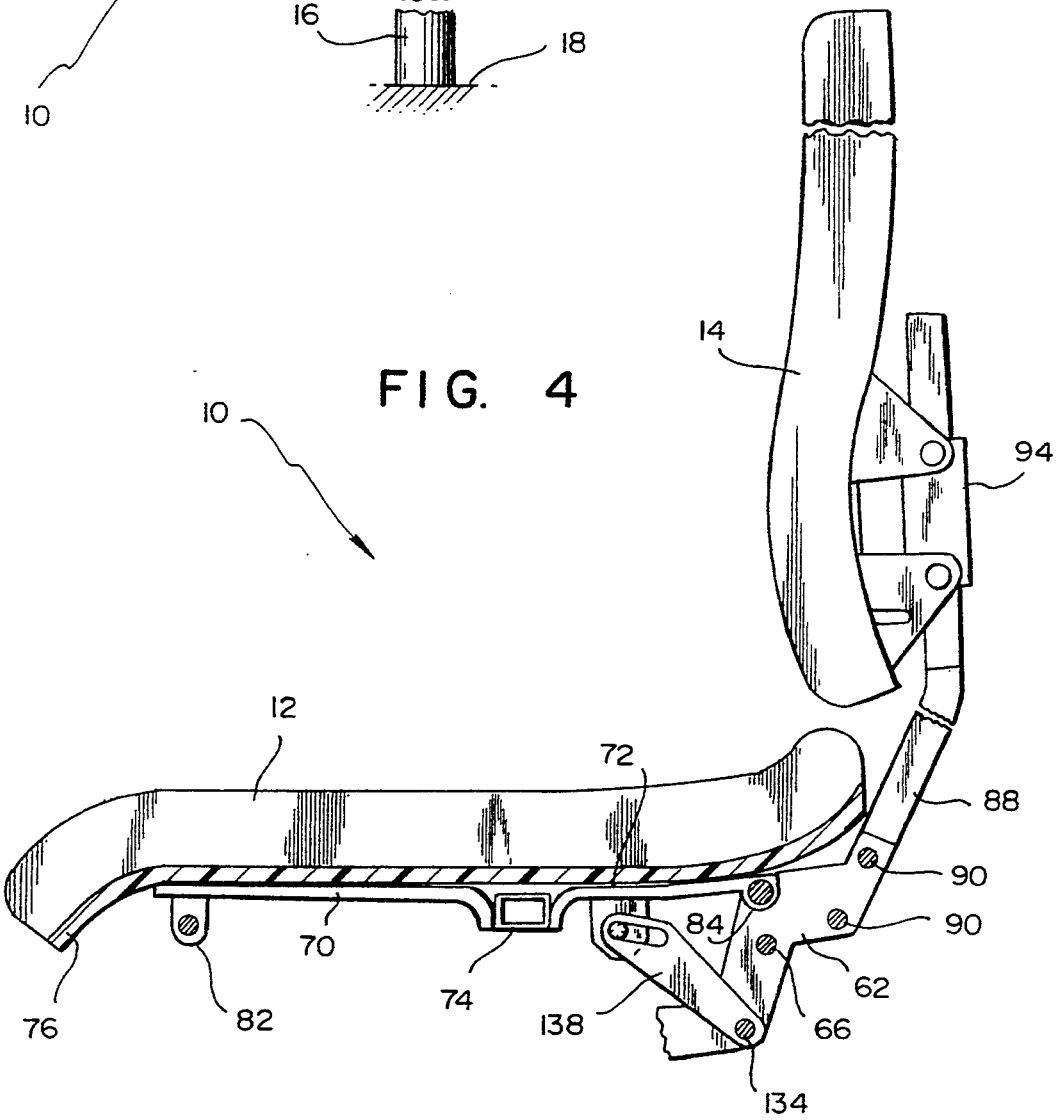
FIG. 4 is a left side elevational view of the seat, a seat back and fragmentary portions of the synchronous movement adjustable seat support.

It should also be noted, from an examination of FIGS. 4 and 9 that a seat back support 88 is joined to the crank 28 at its upper rear end by a pair of through bolts 90 which extend through registered apertures in the crank arms 62. The seat back support 88 is preferably formed of a substantially rectangular elongate metal channel and initially extends rearwardly and upwardly to a bend above the rear edge of the seat, from which bend, the seat back support 88 extends generally vertically.

A plurality of adjustment position apertures 92 are provided on the vertical portion of the seat back support with the apertures being engaged by a bracket sleeve 94 to adjustably position the height of the seat back 14 relative to the seat 12.

Since the pin 86 is coaxial with the slider pivot axis 30, it will be observed that as the seat tilt angle is adjusted, the angle of the seat back support 88 is automatically adjusted, relative to the position of the seat, by pivotal movement about the slider pivot axis 30. Such axis is preferably coincident with the center of rotation of the occupant's hip joint.

In accordance with the invention, a spring mechanism is provided to counterbalance the weight of the seat occupant when the seat tilt angle is adjusted. The spring mechanism includes a helical coil spring 96 which is positioned about a longitudinal axis between the panels 40 and which lies substantially within the axial plane 25. The forward end of the spring 96 engages a retainer plate 98 having a central raised portion 100 which serves to center the spring about the axis.

Attached to the outer face of the retainer plate 98 is an integrally formed collar 102 having a transverse passageway through which the pin 24 extends. Projecting axially from the collar in a direction toward the front end of the base frame 22 is a pin 104. Preferably, the collar 102 is fixed to the retainer disc 98 by welding and the pin 104 is fixed to the collar 102 by welding or by threaded engagement. The pin 104 is coaxial with the spring 96 and extends through an aperture formed in the forward cross plate 42. Such engagement serves as a guide for orienting the spring movement within the plane 25 and centered about the longitudinal axis of the base frame 22.

The opposite end of the spring 96 is seated against a retainer plate 106 having a raised portion 108 facing the spring 96. The raised portion 108 centers the spring about the longitudinal axis. The retainer plate 106 is engaged on a shaft 110, and more specifically, a threaded portion 112 of the shaft. The shaft extends through an enlarged aperture in the intermediate cross plate 44 and includes a journal which extends into a reduced diameter aperture formed in the retainer cross plate 46. The retainer cross plate 46 serves as a bearing wall which counterbalances the compression force of the spring 96, the opposite end of which bears against the pin 24 to bias the slider in a forward tilt position.

With the retainer plate 106 being in threaded engagement with the threaded portion 112 of the shaft 110, and with the retainer plate 106 being fixed against rotation relative to the shaft 110, it will be seen that rotation of the shaft 110 will cause the retainer plate 106 to translate along the shaft 110 to either increase a load on the spring 106 by moving in a direction toward the forward end of the base frame or decrease the compression load on the spring by moving toward the rear end of the base frame. In accordance with the invention, the axial thrust load of the shaft 110 is borne against the retainer cross plate 46 by a pair of lubricated washers 114 which are positioned against the retainer cross plate 46, concentric with the shaft 110 and are engaged by radial flanges 116 which project from the shaft 110.

To rotate the shaft and thus adjust the tension on the spring 96, a plastic worm wheel 118 is molded directly to the shaft 110 and about the radial flanges 116. The worm wheel 118 includes a plurality of teeth 120 which are engaged by a transverse worm 122 carried on a rod 124 extending transversely through registered apertures 125 of the side panels 40.

Pursuant to the invention, an auxiliary leaf spring 126 is provided. The leaf spring 126 comprises a plurality of spring leaves 128 which are clamped, adjacent one of their ends, to the angular cross plate 52, as illustrated in FIG. 5. The clamping arrangement includes a generally flat pressure plate 130 having an aperture registered with mating apertures of the leaves and through which a bolt 132 extends with the bolt being received in a threaded aperture of the angular cross plate 52.

As the seat is tilted rearwardly, the crank 28 moves rearwardly relative to the base frame 22, hence relative to the leaf spring 126. When the rearward movement is such that additional counterbalance force is necessary, the leaves 128 of the leaf spring 126 will be in contact with the rod 66 of the crank 28 and the leaf spring will thus provide additional counterbalance force.

An additional aspect of the invention resides in the implementation of friction lamination plates for the purpose of releasably locking the seat support mechanism 15 in a desired seat tilt angle position.

The implementation of friction lamination plates for the purpose of fixing an adjusted position of a seat component has been disclosed in U.S. Pat. Nos. 4,636,004, 4,198,094 and 4,062,587 as well as European Patent WO 81/00044, all of which are incorporated herein by reference.

Pursuant to the invention, the position of the crank 28 relative to the slider 32 is fixed to thus lock the slider crank linkage 20 in a selected position through the use of a friction lamination plate assembly.

The crank 28 includes a transverse shaft 134 which extends through an aperture 136 formed in each of the crank arms 22. A plurality of friction lamination plates 138 each include an aperture adjacent its lower end. The shaft 134 extends through the lower end apertures. Preferably, the lamination plates are arrayed across the shaft 134 in two packs, with one pack 137 positioned in the space between the leaf spring 126 and one of the crank arms 62 and the other pack 139 being positioned between the leaf spring 126 and the opposite crank arm 62. The lamination packs thus straddle the leaf spring.

Adjacent the opposite end of each lamination plate 138, an elongate slot 140 is provided. A slider shaft 142 extends through the slots 140 as illustrated in FIG. 5. With reference now to FIG. 10, it will be seen that an enlarged concentric cylinder 143 is carried on the slider shaft 142. The cylinder 143 is of a length equal to the width of the leaf spring 126. The lamination plates 138 are mounted to the shaft 142 with the cylinder 143 being positioned between each pack. Preferably, each of the lamination plates 138 is separated from an adjacent plate by a washer 145 having a high coefficient of friction.

As illustrated in FIG. 8, projecting downwardly from the slider at the plate 80 is a pair of registered brackets 144, 146. The slider shaft 142 is coaxial with such brackets. A shaft portion 147 projecting beyond the bracket 144 includes a concentric helical coil spring 150, a retaining washer 152 and a nut 154 such that the spring force tends to pull the slider shaft 142 toward the left as viewed in FIG. 10 and through the bracket 144. A similar lamination plate structure, utilizing bevel spring washers in lieu of a helical coil spring, is illustrated in European Patent WO 81/00044.

Adjacent, yet inwardly spaced from the bracket 146, the slider shaft 142 carries a compression abutment 156. The force of the spring 150 tends to cause the abutment 156 to engage the lamination pack 139, urging the lamination plates 138 against one another with the spring force extending to the other pack 137 through the cylinder 143 and urging the lamination plates of the pack 137 against one another and against the bracket 144. The lamination plates are thus fixed in position, preventing movement of the components of the slider crank linkage 20.

The bracket 146 includes a noncircular keyway aperture 148 and the end of slider shaft 142 is threaded axially into a mating noncircular key 158, the key extends through the aperture 148 and includes a transverse pin 160. The lamination plates may be released by actuation of a lever yoke 162 through which the pin 160 extends. The yoke 162 includes a cam face 164 resting against the outside of the bracket 146. When the yoke is rotated about the pin 160 by moving a lever arm 166, it pulls the slider shaft 142 to the right as viewed in FIG. 10 against the bias of the spring 150, thereby releasing the lamination plates 138 and permitting movement of the components of the slider crank linkage 20.

Thus it will be seen that there is provided a synchronous movement adjustable seat support which achieves the various aspects, features and considerations of the present invention and which is well suited to meet the conditions of practical usage.

Since various changes might be made in the exemplary embodiment of the invention set forth herein without departing from the spirit of the invention and various additional embodiments might be made in the present invention, it is to be understood that all matter herein described or shown in the accompanying drawings is to be interpreted as illustrative and not in a limiting sense.

Having thus described the invention, there is claimed as new and desired to be secured by letters patent:

1. A counterbalanced seat support mechanism for interconnecting a chair seat with a vertical support post and for varying the angle of inclination of the seat, the seat support mechanism including a base frame having a pair of side panels, first means for attachment of the base frame to the support post, second means for attachment of a front portion of the base frame to the seat substantially adjacent a front portion of the seat, crank means for linking a rear portion of the base frame to a rear portion of the seat, the second means for attachment comprising a pin, means fixing the pin against translational movement relative to the seat, the pin being positioned transverse to the side panels, means forming a pair of slots in the forward portion of the base frame, the slots being downwardly and rearwardly inclined toward the rear portion of the base frame, the pin passing through the slots, the seat support mechanism further including means for pivotally interconnecting the crank means to the base frame and to the seat, the pin translating rearwardly and downwardly within the slots when the angle of rearward inclination of the seat is increased, the seat support mechanism further including counterbalance means positioned between the side panels, the counterbalance means comprising an elongate spring, the base frame including a transverse cross plate extending between and interconnecting the side panels adjacent the rear portion of the base frame, one end of the spring bearing against the cross plate, the other end of the spring bearing against the pin to urge the pin upwardly and forwardly within the slots and simultaneously urge the seat toward a substantially horizontal position, the spring serving to counterbalance the weight of a seat occupant when adjusting the seat to a rearward tilt position, the seat support mechanism further including an auxiliary counterbalance spring, the auxiliary counterbalance spring comprising a leaf spring, the leaf spring being positioned between the side panels, one end of the leaf spring being fixed to the base frame and abutment means for engaging and deflecting the leaf spring, the abutment means increasing the deflection of the leaf spring as a function of the increasing rearward tilt of the seat, the abutment means being carried by the crank means.

2. A counterbalanced seat support mechanism as constructed in accordance with claim 1 wherein the chair seat includes a seat bottom, the seat support mechanism further including a slider, means for fixing the slider to the seat bottom, the slider including a first pair of downwardly projecting brackets having bores, the first pair of brackets being positioned adjacent a forward end of the slider, the pin extending through the bores, the slider having a second pair of downwardly projecting brackets adjacent the rear end of the slider, the crank means being pivotally connected to the seat at the second pair of brackets.

3. A counterbalanced seat support mechanism as constructed in accordance with claim 2 wherein the slider includes a pair of substantially parallel bars, one of the brackets of the first pair of brackets extending from each of the bars.

4. A counterbalanced seat support mechanism as constructed in accordance with claim 3 wherein the slider further includes a second pair of substantially parallel bars, one of the brackets of the second pair of brackets extending from each of the bars of the second pair of bars.

5. A counterbalanced seat support mechanism as constructed in accordance with claim 4, the slider further including a transverse open ended channel, the channel interconnecting the pairs of bars, the channel including means for receiving seat arm brackets.

6. A counterbalanced seat support mechanism as constructed in accordance with claim 1 wherein the seat and the crank means move relative to one another when the seat tilt angle is adjusted, the seat support mechanism further including means for fixing the seat in a desired tilt angle position, the means for fixing including a plurality of lamination plates, means interconnecting each lamination plate between the seat and the crank means, the interconnecting means including means for permitting relative movement between the seat, the lamination plates and the crank means, the fixing means further including compression means for fixing the lamination plates relative to the seat and relative to the crank means to prevent movement between the seat and the crank means.

7. A counterbalanced seat support mechanism for interconnecting a chair seat with a vertical support post and for varying the angle of inclination of the seat, the seat support mechanism including a base frame having a pair of side panels, first means for attachment of the base frame to the support post, second means for attachment of a front portion of the base frame to the seat substantially adjacent a front portion of the seat, crank means for linking a rear portion of the base frame to a rear portion of the seat, the second means for attachment comprising a pin, means fixing the pin against translational movement relative to the seat, the pin being positioned transverse to the side panels, means forming a pair of slots in the forward portion of the base frame, the slots being downwardly and rearwardly inclined toward the rear portion of the base frame and the pin passing through the slots, the seat support mechanism further including means for pivotally interconnecting the crank means to the base frame and to the seat, the pin translating rearwardly and downwardly within the slots when the angle of rearward inclination of the seat is increased, the seat support mechanism further including counterbalance means positioned between the side panels, the counterbalance means comprising an elongate helical coil spring, the base frame including a transverse cross plate extending between and interconnecting the side panels adjacent the rear portion of the base frame, one end of the spring bearing against the cross plate, the other end of the spring bearing against the pin to urge the pin upwardly and forwardly within the slots and simultaneously urge the seat toward a substantially horizontal position, the spring serving to counterbalance the weight of a seat occupant when adjusting the seat to a rearward tilt position, means for adjustably varying a compression load applied to the spring, the means for varying comprising a shaft coaxial with the spring and a retainer plate in engagement with an end of the spring, the retainer plate having a threaded aperture, the shaft having a matingly threaded portion extending through the aperture, means for fixing the retainer plate against rotation, the shaft engaging the cross plate, a rotatable adjustment rod mounted transverse to the side plates, the adjustment rod being in worm engagement with a portion of the shaft adjacent the cross plate.

8. A counterbalanced seat support mechanism as constructed in accordance with claim 7 wherein the chair seat includes a seat bottom, the seat support mechanism further including a slider, means for fixing the slider to the seat bottom, the slider including a first pair of downwardly projecting brackets having bores, the first pair of brackets being positioned adjacent a forward end of the slider, the pin extending through the bores, the slider having a second pair of downwardly projecting brackets adjacent the rear end of the slider, the crank means being pivotally connected to the seat at the second pair of brackets.

9. A counterbalanced seat support mechanism as constructed in accordance with claim 8 wherein the slider includes a pair of substantially parallel bars, one of the brackets of the first pair of brackets extending from each of the bars.

10. A counterbalanced seat support mechanism as constructed in accordance with claim 9 wherein the slider further includes a second pair of substantially parallel bars, one of the brackets of the second pair of brackets extending from each of the bars of the second pair of bars.

11. A counterbalanced seat support mechanism as constructed in accordance with claim 7 wherein the seat and the crank means move relative to one another when the seat tilt angle is adjusted, the seat support mechanism further including means for fixing the seat in a desired tilt angle position, the means for fixing including a plurality of lamination plates, means interconnecting each lamination plate between the seat and the crank means, the interconnecting means including means for permitting relative movement between the seat, the lamination plates and the crank means, the fixing means further including compression means for fixing the lamination plates relative to the seat and relative to the crank means to prevent movement between the seat and the crank means.

12. A counterbalanced seat support mechanism as constructed in accordance with claim 7 wherein the base frame further includes an intermediate cross plate extending between the side panels, the intermediate cross plate being substantially parallel to the transverse cross plate and being positioned adjacent and forwardly of the transverse cross plate, means for journalling the shaft within the intermediate cross plate and the transverse cross plate, the shaft carrying a plastic worm wheel between the cross plates, means for non-rotatively fixing the worm wheel to the shaft, the adjustment rod carrying a worm, the worm being in engagement with the worm wheel for adjustment of the compression load applied to the spring.

13. A counterbalanced seat support mechanism for interconnecting a chair seat with a vertical support post and for varying the angle of inclination of the seat, the seat support mechanism including a base frame having a pair of side panels, first means for attachment of the base frame to the support post, second means for attachment of a front portion of the base frame to the seat substantially adjacent a front portion of the seat, crank means for linking a rear portion of the base frame to a rear portion of the seat, the second means for attachment comprising a pin, means fixing the pin against translational movement relative to the seat, the pin being positioned transverse to the side panels, means forming a pair of slots in the forward portion of the base frame, the slots being downwardly and rearwardly inclined toward the rear portion of the base frame, the pin passing through the slots, the seat support mechanism further including means for pivotally interconnecting the crank means to the base frame and to the seat, the pin translating rearwardly and downwardly within the slots when the angle of rearward inclination of the seat is increased, the seat support mechanism further including counterbalance means positioned between the side panels, the counterbalance means comprising an elongate spring, the base frame including a transverse cross plate extending between and interconnecting the side panels adjacent the rear portion of the base frame, one end of the spring bearing against the cross plate, the other end of the spring bearing against the pin to urge the pin upwardly and forwardly within the slots and simultaneously urge the seat toward a substantially horizontal position, the spring serving to counterbalance the weight of a seat occupant when adjusting the seat to a rearward tilt position, the support mechanism further including means for selectively fixing an adjusted tilt angle of the seat, the fixing means comprising lamination plates, the seat and the support mechanism moving relative to each other as a function adjustment of the seat tilt angle, means for coupling each lamination plate to the seat and to the support mechanism such that movement of the seat relative to the support mechanism causes relative movement of the lamination plates, each lamination plate including a slot, the means for coupling including a shaft, the shaft extending through the slots of the lamination plates, adjustment of the seat tilt angle resulting in relative movement between the lamination plate slots and the shaft, the means for selectively fixing an adjusted tilt angle of the seat further including means for compressing the lamination plates toward one another adjacent the slot for fixing the lamination plates relative to the shaft.

14. A counterbalanced seat support mechanism as constructed in accordance with claim 13 wherein the means for coupling each lamination plate to the seat and to the support mechanism includes means for pivotally mounting each lamination plate to the crank means and means for fixing the shaft relative to the seat.

15. A counterbalanced seat support mechanism as constructed in accordance with claim 13 wherein the seat includes a seat bottom, the seat support mechanism further including a slider, means for fixing the slider to the seat bottom, the slider including a first pair of downwardly projecting brackets having bores, the first pair of brackets being positioned adjacent a forward end of the slider, the pin extending through the bores, the slider having a second pair of downwardly projecting brackets adjacent the rear end of the slider, the crank means being pivotally connected to the seat at the second pair of brackets, the slider having a third pair of downwardly projecting brackets, the shaft being mounted to the third pair of brackets, the means for compressing the lamination plates toward one another including means for compressing the lamination plates against one of the brackets of the third pair of brackets.

16. A counterbalanced seat support mechanism as constructed in accordance with claim 15 wherein the slider further includes a second pair of substantially parallel bars, one of the brackets of the second pair of brackets extending from each of the bars of the second pair of bars.

17. A counterbalanced seat support mechanism as constructed in accordance with claim 16, the slider further including a transverse open ended channel, the channel interconnecting the pairs of bars, the channel including means for receiving seat arm brackets.

18. A counterbalanced seat support mechanism as constructed in accordance with claim 15 wherein one of the brackets of the third pair of brackets extends from one of the bars of the second pair of bars.

19. A counterbalanced seat support mechanism as constructed in accordance with claim 13 further including an auxiliary counterbalance leaf spring, the leaf spring being positioned between the side panels, one end of the leaf spring being fixed to the base frame, the support mechanism further including abutment means for engaging and deflecting the leaf spring, the abutment means increasing the deflection of the leaf spring as a function of the increasing rearward tilt of the seat, the abutment means being carried by the crank means, the lamination plates being carried between the side panels, the lamination plates being segregated into two packs, each pack being positioned between the leaf spring and one of the side panels, and spacer means for maintaining each pack of lamination plates between the side panels and the leaf spring, the spacer means being carried on the shaft.

20. A counterbalanced seat support mechanism as constructed in accordance with claim 13 further including a plurality of friction washers, the friction washers being carried on the shaft between adjacent lamination plates.

* * * * *